US005706804A

United States Patent [19]

Baumann et al.

[11] Patent Number: 5,706,804

[45] Date of Patent: Jan. 13, 1998

[54] LIQUID RESISTANT FACE MASK HAVING SURFACE ENERGY REDUCING AGENT ON AN INTERMEDIATE LAYER THEREIN

[75] Inventors: Nicholas R. Baumann; John M. Brandner; John A. Temperante, all of St. Paul, Minn.; Shannon Dowdell, Indianapolis, Ind.; Michael D. Romano, Circle Pines, Minn.; Scott J. Tuman; Matthew T. Scholz, both of Woodbury, Minn.

[73] Assignee: Minnesota Mining and Manufacturing Company, St. Paul, Minn.

[21] Appl. No.: 791,918

[22] Filed: Jan. 31, 1997

Related U.S. Application Data

[63] Continuation-in-part of Ser. No. 724,360, Oct. 1, 1996, abandoned.

[51] Int. Cl.[6] ..... A62B 7/10; A62B 18/02; A62B 23/02

[52] U.S. Cl. ..... 128/206.19; 128/206.12; 128/206.21

[58] Field of Search ..... 128/206.12, 206.19, 128/206.21, 201.25, 863

[56] References Cited

U.S. PATENT DOCUMENTS

| | | | |
|---|---|---|---|
| Re. 30,782 | 10/1981 | van Turnhout | 264/22 |
| Re. 31,285 | 6/1983 | van Turnhout | 55/155 |
| 3,220,409 | 11/1965 | Liloia et al. | 128/206.19 |
| 3,613,678 | 10/1971 | Mayhew | 128/146.2 |
| 3,888,246 | 6/1975 | Lauer | 128/146.2 |
| 3,890,966 | 6/1975 | Aspelin et al. | 128/146.2 |
| 3,929,135 | 12/1975 | Thompson | 604/374 |
| 3,971,373 | 7/1976 | Braun | 128/146.2 |
| 3,974,829 | 8/1976 | Tate, Jr. | 128/146.2 |
| 4,011,067 | 3/1977 | Carey, Jr. | 55/354 |
| 4,037,593 | 7/1977 | Tate, Jr. | 128/146.2 |
| 4,069,026 | 1/1978 | Simm et al. | 55/6 |
| 4,100,324 | 7/1978 | Anderson et al. | 428/288 |
| 4,300,549 | 11/1981 | Parker | 128/206.12 |
| 4,419,993 | 12/1983 | Petersen | 128/206.19 |
| 4,429,001 | 1/1984 | Kolpin et al. | 428/283 |
| 4,508,113 | 4/1985 | Malaney | 128/206.19 |
| 4,522,203 | 6/1985 | Mays | 128/206.19 |
| 4,606,341 | 8/1986 | Hubbard et al. | 128/206.19 |
| 4,616,647 | 10/1986 | McCreadie | 128/206.19 |
| 4,635,628 | 1/1987 | Hubbard et al. | 128/206.19 |
| 4,641,645 | 2/1987 | Tayebi | 128/206.19 |
| 4,802,473 | 2/1989 | Hubbard et al. | 128/206.19 |
| 4,883,052 | 11/1989 | Weiss et al. | 128/206.19 |

(List continued on next page.)

FOREIGN PATENT DOCUMENTS

| | | |
|---|---|---|
| PCT/US89/01629 | 11/1989 | WIPO . |
| PCT/US92/08824 | 4/1993 | WIPO . |

OTHER PUBLICATIONS

Wente, Van A., "Superfine Thermoplastic Fibers," *Industrial Engineering Chemistry*, vol. 48, pp. 1342–1346 (1956).

Went et al., Report No. 4364 for the Naval Research Laboratories, published May 25, 1954, entitled, "Manufacture of Superfine Organic Fibers".

Davies, C.N. "The Separation of Airborne Dust and particles," Institution of Mechanical Engineers, London, Proceedings 1B, 1952.

*Primary Examiner*—Kimberly L. Asher

*Attorney, Agent, or Firm*—Robert W. Sprague

[57] ABSTRACT

A face mask including a face-contacting layer, an outer cover layer, a polymeric microfiber mat disposed between the face-contacting layer and the outer cover layer, and a non-woven fibrous mat disposed between the face-contacting layer and the outer cover layer. The non-woven fibrous mat includes polymeric fibers and a surface energy reducing agent. The face-contacting layer, the cover layer, the polymeric microfiber mat, and the non-woven fibrous mat cooperate with each other to allow gas to pass through the mask while inhibiting the passage of liquid through the mask.

35 Claims, 1 Drawing Sheet

*Fig.2*

U.S. PATENT DOCUMENTS

| | | | |
|---|---|---|---|
| 4,920,960 | 5/1990 | Hubbard et al. | 128/206.19 |
| 4,938,832 | 7/1990 | Schmalz | 156/308.8 |
| 4,941,470 | 7/1990 | Hubbard et al. | 128/206.13 |
| 4,944,294 | 7/1990 | Borek, Jr. et al. | 128/206.12 |
| 4,966,140 | 10/1990 | Herzberg | 128/206.19 |
| 4,969,457 | 11/1990 | Hubbard et al. | 128/206.19 |
| 5,020,533 | 6/1991 | Hubbard et al. | 128/206.23 |
| 5,025,052 | 6/1991 | Crater et al. | 524/104 |
| 5,027,803 | 7/1991 | Scholz et al. | 128/89 R |
| 5,099,026 | 3/1992 | Crater et al. | 548/229 |
| 5,150,703 | 9/1992 | Hubbard et al. | 128/206.12 |
| 5,380,260 | 1/1995 | Blott | 602/41 |
| 5,411,576 | 5/1995 | Jones et al. | 95/57 |
| 5,418,051 | 5/1995 | Caldwell | 428/240 |
| 5,422,159 | 6/1995 | Fagan | 428/131 |
| 5,451,622 | 9/1995 | Boardman et al. | 524/100 |
| 5,496,507 | 3/1996 | Angadjivand et al. | 264/423 |
| 5,553,608 | 9/1996 | Reese et al. | 128/206.24 |

LIQUID RESISTANT FACE MASK HAVING SURFACE ENERGY REDUCING AGENT ON AN INTERMEDIATE LAYER THEREIN

This application is a continuation-in-part of U.S. patent application Ser. No. 08/724,360 filed Oct. 1, 1996, now abandoned.

BACKGROUND OF THE INVENTION

The present invention relates to inhibiting the passage of liquids through a face mask.

It is desirable to greatly reduce, if not eliminate, transmission of blood and body liquids (e.g., urine and saliva) and airborne contaminates (e.g., bacteria, viruses, and fungal spores) through a surgical face mask. At the same time, it is desirable to allow gases to flow through the mask in order to make the mask breathable and comfortable.

SUMMARY OF THE INVENTION

In general, the invention features a face mask that includes a face-contacting layer, an outer cover layer, a polymeric microfiber mat disposed between the face-contacting layer and the outer cover layer, and a non-woven fibrous mat disposed between the face-contacting layer and the outer cover layer. The non-woven fibrous mat includes polymeric fibers and a surface energy reducing agent. The face-contacting layer, the cover layer, the polymeric microfiber mat, and the non-woven fibrous mat cooperate with each other to allow gas to pass through the mask while inhibiting the passage of liquid through the mask.

In preferred embodiments, the mask has a basis weight of no greater than about 95 g/m$^2$. The pressure drop across the mask preferably is no greater than about 2.70 mm $H_2O$ at a flow rate of 32 liters per minute ("lpm") and a face velocity of 3.82 cm/s, as measured according to ASTM F 778-88. In one preferred embodiment, the non-woven fibrous mat is disposed between the outer cover layer and the polymeric microfiber mat. In another preferred embodiment, the non-woven fibrous mat is disposed between the face-contacting layer and the polymeric microfiber mat.

The surface energy reducing agent preferably is a fluorochemical, a wax, a silicone, or a combination thereof, with fluorochemicals being preferred. Examples of preferred fluorochemicals include fluorochemical oxazolidinones, fluorochemical piperazines, fluoroaliphatic radical-containing compounds, and combinations thereof, with fluorochemical oxazolidinones being particularly preferred. The surface energy reducing agent may be incorporated into some or all of the fibers, applied to the surface of some or all of the fibers, or a combination thereof. The amount of the surface energy reducing agent preferably is no greater than about 4.0% by weight based upon the total weight of the non-woven fibrous mat, more preferably no greater than about 2.0% by weight.

Suitable fibers for use in the non-woven fibrous mat include, for example, polymeric microfibers, staple fibers, continuous filament fibers, and combinations thereof. Examples of suitable polymeric microfibers include polyolefin (e.g., polyethylene, polypropylene, polybutylene, or poly-4-methylpentene), polyamide, polyester, and polyvinylchloride microfibers, and combinations thereof, with blends of polypropylene and polybutylene microfibers being particularly preferred. In one preferred embodiment, the non-woven fibrous mat includes a blend of up to about 50% by weight polypropylene microfibers and up to about 50% by weight polybutylene microfibers; the mat may further include about 0.5% by weight of the surface energy reducing agent (e.g., a fluorochemical).

Preferably, the non-woven fibrous mat has a solidity of no greater than about 10%; an average basis weight ranging between about 10 and about 50 g/m$^2$ (where the measurement is based upon mass per projected area); and an average effective fiber diameter no greater than about 20 micrometers, more preferably between about 1 and 10 micrometers. The pressure drop across the non-woven fibrous mat preferably ranges from about 0.1 to about 2.70 mm $H_2O$ at a flow rate of 32 liters per minute ("lpm") and a face velocity of 3.82 cm/s, as measured according to ASTM F 778-88, more preferably from about 0.1 to about 2.50 mm $H_2O$, and even more preferably from about 0.1 to about 1.50 mm $H_2O$. The area of the non-woven fibrous mat (measured by multiplying the length of the mat times its width) is preferably at least about 2% greater than the area (measured by multiplying length times width of the mat prior to pleating) of any one of the face-contacting layer, the polymeric microfiber mat, or the outer cover layer to cause the non-woven fibrous mat to "pucker." The non-woven fibrous mat may be provided in the form of an electret.

The mask may include an air impervious element secured to the mask to inhibit the flow of air to the eyes of the wearer of the mask. In another embodiment, the mask may include a shield affixed to the mask to extend over and protect the eyes of the wearer of the face mask. In yet another embodiment, the mask may include a pair of flaps affixed to opposite sides of the mask to inhibit liquid from reaching the face of the wearer. The mask may also assume an off-the-face (i.e., a "duck-bill") configuration.

As used herein, the term "average effective fiber diameter" refers to the fiber diameter calculated according to the method set forth in Davies, C. N., "The Separation of Airborne Dust and Particles," Institution of Mechanical Engineers, London, Proceedings 1B, 1952. The average effective fiber diameter can be estimated by measuring the pressure drop of air passing through the major face of the web and across the web as outlined in ASTM F 778-88.

The face-contacting layer and the outer cover layer preferably are non-woven mats that include polyolefin fibers, cellulosic fibers, polyester fibers, polyamide fibers, ethylene-vinyl acetate fibers, or a combination thereof. The polymeric microfiber layer preferably includes a fluorochemical incorporated into the microfibers.

The invention provides face masks that are permeable to gases, but at the same time are substantially impermeable to liquids. The masks are lightweight, breathable, and comfortable, yet block the passage of liquids such as blood and body fluids from secretions and excretions in two directions. The masks thus protect the wearer and patients with whom the wearer comes in contact from each other.

Other features and advantages of the invention will become apparent from the following description of the preferred embodiments thereof, and from the claims.

DESCRIPTION OF THE PREFERRED EMBODIMENTS

Figure 1:
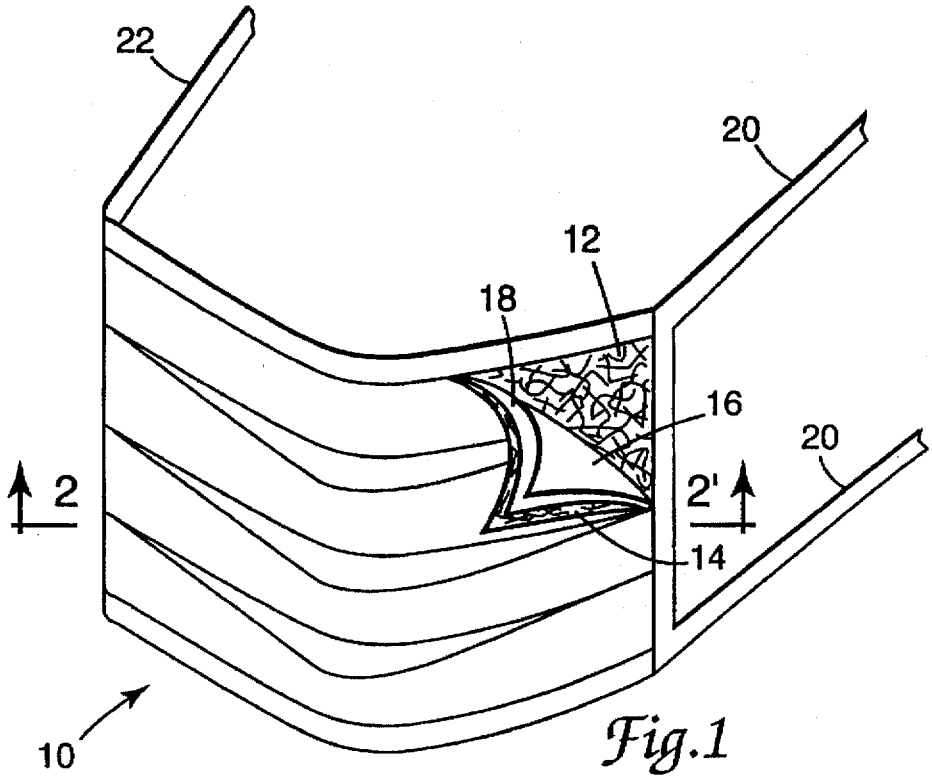
FIG. 1 is a perspective view, partially broken away, of a face mask embodying the present invention.
Figure 2:
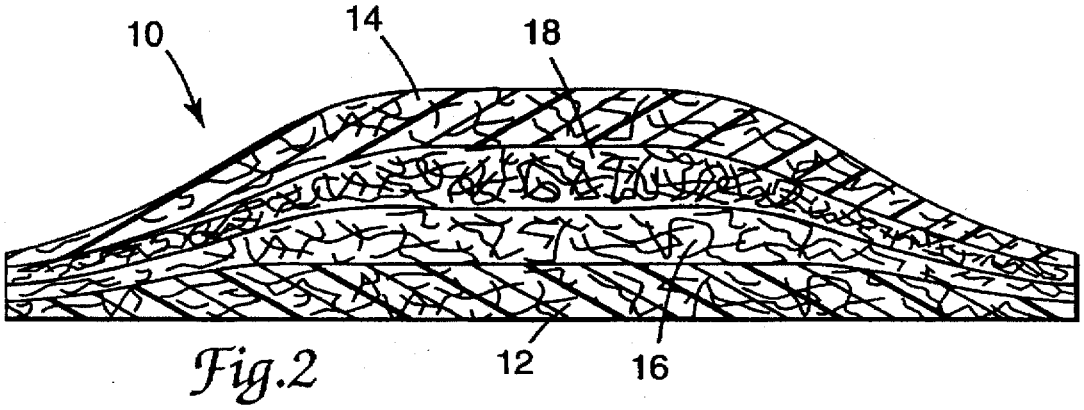
FIG. 2 is a cross-section view, taken at 2-2', of the face mask shown in FIG. 1.

Referring to FIGS. 1 and 2, there is shown a face mask 10 featuring four layers (12, 14, 16, and 18) that cooperate with each other to allow gas to pass through the mask while inhibiting the passage of liquid through the mask. The mask thus affords protection from blood and body fluids from secretions and excretions without adversely affecting other mask characteristics such as breathability and filtering ability. Preferably, the mask has a basis weight no greater than about 95 g/m$^2$ and a pressure drop no greater than about 2.70 mm $H_2O$, preferably no greater than about 2.50 mm $H_2O$, more preferably no greater than about 1.50 mm $H_2O$ at a flow rate of 32 lpm and a face velocity of 3.82 cm/s, and can withstand at least ten exposures to synthetic blood without visible penetration by the synthetic blood, as determined according to the Synthetic Blood Challenge Test described infra. A pair of ties 20, 22 is used to fasten the mask on the wearer's face.

The area of layer 18 (a non-woven fibrous mat described in greater detail, below) is preferably at least about 2% greater than the area of any one of layers 12, 14, and 16 to cause layer 18 to "pucker," as shown in FIG. 2. The area is measured by multiplying the length of the layer times its width prior to pleating. This "puckering" inhibits wicking of liquid into face-contacting layer 12 (described in greater detail, below) to afford protection against liquid penetration.

Layer 12 is a face-contacting layer, while layer 14 is an outer cover layer. The purpose of layers 12 and 14 is to contain microfiber-containing layers 16 and 18, thereby shielding the wearer from loose microfibers (in the case of layer 12), as well as preventing loose microfibers from falling off the mask (in the case of layer 14). Layers 12 and 14 can be made from any low-linting fibrous web such as a non-woven web made from cellulosic, polyolefin, polyamide, polyester, or ethylene-vinyl acetate fibers, or a combination thereof. Examples of suitable cellulosic fibers include rayon, while examples of suitable polyolefin fibers include polyethylene, polypropylene, and polybutylene. Examples of suitable polyamides include nylon, while suitable polyesters include polyethylene terephthalate and polybutylene terephthalate. The surface of either web may be treated with a surface energy reducing agent such as a fluorochemical to increase liquid repellency.

The pressure drop and basis weight of layers 12 and 14 are selected to maximize air flow through the mask in either direction, and thus breathability. In general, the pressure drop through face-contacting layer 12 and outer cover layer 14 is preferably no greater than about 0.5 mm $H_2O$ at a flow rate of 32 lpm and a face velocity of 3.82 cm/s in the case of each individual layer. In addition, each layer preferably has a basis weight of about 20 to about 30 g/m$^2$.

Layer 18 is a non-woven fibrous mat designed to act in concert with the other layers of the mask to repel liquids and to filter airborne contaminants, while at the same time allowing the passage of gas through the mask to provide breathability. The non-woven fibrous mat may include polymeric microfibers, staple fibers, continuous fiber filaments, or a combination thereof, with polymeric microfibers being preferred.

The solidity, effective fiber diameter, and pressure drop across the mat are selected to maximize breathability. Preferably, mat 18 has a solidity of no greater than about 10%; an average effective fiber diameter no greater than about 20 μm, more preferably between about 1 and about 10 μm; and a pressure drop between about 0.1 and about 2.70 mm $H_2O$, more preferably between about 0.1 and about 2.50 mm $H_2O$, even more preferably between about 0.1 and about 1.5 mm $H_2O$ measured at a flow rate of 32 lpm and a face velocity of 3.82 cm/s.

The fibers of mat 18 include one or more surface energy reducing agents to increase the liquid resistance of the mat, and thus mask 10. The surface energy reducing agent increases the hydrophobicity of the fibers, which in turn enhances the filtration efficiency and the liquid resistance of the mat. The amount of surface energy reducing agent is preferably the minimum amount needed to obtain the desired level of liquid resistance and filtration. In general, the amount of surface energy reducing agent is no greater than about 4.0% by weight based upon the total weight of the mat, preferably no greater than about 2.0% by weight, more preferably no greater than about 1.0% by weight, even more preferably no greater than about 0.5% by weight.

The surface energy reducing agent may be incorporated into the fibers of non-woven mat 18 (e.g., by adding the agent to the melt used to prepare the fibers), applied topically to the surface of the fibers (e.g., by coating or by incorporating the agent into the fiber sizing), or a combination thereof. Preferably, the agent is incorporated into the fibers of mat 18 by including the agent in the melt used to prepare the fibers, in which case the agent is selected such that it suffers substantially no degradation under the melt processing conditions used to form the fibers, and has a melting point of at least about 70° C., more preferably at least about 100° C.

Suitable surface energy reducing agents include fluorochemicals, silicones, waxes, and combinations thereof, with fluorochemicals being preferred.

Examples of suitable silicones include those based on polymers of methyl (hydrogen) siloxane and of dimethylsiloxane. Also suitable are silicones described in U.S. Pat. No. 4,938,832 (Schmalz), hereby incorporated by reference.

Examples of suitable waxes include paraffin waxes. Such materials may be provided in the form of an emulsion.

Examples of suitable fluorochemicals include fluorochemical compounds and polymers containing fluoroaliphatic radicals or groups, Rf, as described in U.S. Pat. No. 5,027,803 (Scholz et al.), hereby incorporated by reference. The fluoroaliphatic radical, Rf, is a fluorinated, stable, inert, non-polar, preferably saturated, monovalent moiety which is both hydrophobic and oleophobic. It can be straight chain, branched chain, or, if sufficiently large, cyclic, or combinations thereof, such as alkylcycloaliphatic radicals. The skeletal chain in the fluoroaliphatic radical can include catenary divalent oxygen atoms and/or trivalent nitrogen atoms bonded only to carbon atoms. Generally Rf will have 3 to 20 carbon atoms, preferably 6 to 12 carbon atoms and will contain about 40 to 78 weight percent, preferably 50 to 78 weight percent, carbon-bound fluorine. The terminal portion of the Rf group has at least one trifluoromethyl group, and preferably has a terminal group of at least three fully fluorinated carbon atoms, e.g., $CF_3CF_2CF_2$—. The preferred Rf groups are fully or substantially fluorinated, as in the case where Rf is perfluoroalkyl, $C_nF_{2n+1}$—.

Classes of fluorochemical agents or compositions useful in this invention include compounds and polymers containing one or more fluoroaliphatic radicals, Rf. Examples of such compounds include, for example, fluorochemical urethanes, ureas, esters, amines (and salts thereof), amides, acids (and salts thereof), carbodiimides, guanidines, allophanates, biurets, and compounds containing two or more of these groups, as well as blends of these compounds.

Particularly preferred fluorochemicals include fluorochemical oxazolidinones, fluorochemical piperazines, fluoroaliphatic radical containing-radicals, and combinations thereof. Specific examples are provided in U.S. Pat. Nos.

5,025,052 (Crater et al.), 5,099,026 (Crater et al.), and 5,451,622 (Boardman et al.), each of which is incorporated by reference. A particularly useful fluorochemical is a fluorochemical oxazolidinone prepared according to the procedure described generally in Example 1 of Crater et al., U.S. Pat. No. 5,025,052 by reacting a monoisocyanate having the formula $O{=}C{=}N{-}C_{18}H_{17}$ with $C_{18}F_{17}SO_2N(CH_3)CH_2CH(OH)CH_2Cl$ to form an intermediate urethane, followed by treatment with $NaOCH_3$ to form the oxazolidinone.

Preferred polymers for forming fibers used in the construction of mat 18 include polyolefins (e.g., polyethylene, polypropylene, polybutylene, and poly-4-methylpentene), polyesters, polyamides (e.g., nylon), polycarbonates, polyphenylene oxide, polyurethanes, acrylic polymers, polyvinylchloride, and mixtures thereof, with polypropylene and polybutylene being preferred. Preferably, mat 18 is a blend of up to about 50% by weight polypropylene microfibers and up to about 50% by weight polybutylene microfibers. Particularly preferred are blends that include about 80% by weight polypropylene microfibers and about 20% by weight polybutylene microfibers.

Mat 18 may be formed using conventional techniques for preparing non-woven mats such as melt blowing, air laying, carding, wet laying, solvent spinning, melt spinning, solution blowing, spun bonding, and spraying. Preferably, the mats are prepared by melt blowing. Melt-blown microfibers can be prepared, for example, by the methods described in Wente, Van A., "Superfine Thermoplastic Fibers," *Industrial Engineering Chemistry,* vol. 48, pp. 1342–46; in Report No. 4364 for the Naval Research Laboratories, published May 25, 1954, entitled, "Manufacture of Super Fine Organic Fibers" by Wente et al.; and in U.S. Pat. Nos. 3,971,373 (Braun), 4,100,324 (Anderson), and 4,429,001 (Kolpin et al.), which patents are incorporated herein by reference. In addition, U.S. Pat. No. 4,011,067 (Carey, Jr.) describes methods for making mats of polymeric microfibers using solution blown techniques, and U.S. Pat. No. 4,069,026 (Simm et al.) discloses electrostatic techniques.

Where mat 18 features melt-blown microfibers in which the surface energy reducing agent is a fluorochemical added to the melt used to prepared the fibers, the fluorochemical may be incorporated into the microfibers according to methods disclosed in the aforementioned Crater and Boardman patents. For example, a solid fluorochemical can be blended with a solid synthetic polymer by intimately mixing the solid fluorochemical with pelletized or powdered polymer, and then melt-extruding the blend through an orifice into fibers or films by known methods. Alternatively, the fluorochemical can be mixed per se with the polymer, or the fluorochemical can be mixed with the polymer in the form of a "masterbatch" (concentrate) of the fluorochemical compound in the polymer. Masterbatches typically contain from about 10% to about 25% by weight of the additive. Also, an organic solution of the fluorochemical may be mixed with the powdered or pelletized polymer, dried to remove solvent, melted, and extruded. Molten fluorochemical can also be injected into a molten polymer stream to form a blend just prior to extrusion into fibers or films.

The fluorochemical can also be added directly to the polymer melt, which is then subjected to melt-blowing according to the process disclosed in the aforementioned Wente reports to prepare a fluorochemical-containing, melt-blown microfiber mat.

The filtering efficiency of mat 18 can be improved by bombarding the melt-blown microfibers, as they issue from the extrusion orifices, with electrically charged particles such as electrons or ions. The resulting fibrous web is an electret. Similarly, the mat can be made an electret by exposing the web to a corona after it is collected. Examples of suitable electret-forming processes are described in U.S. Pat. Nos. 5,411,576 (Jones, et al.), 5,496,507 (Angadjivand et al.), Re. 30,782 (van Turnbout), and Re. 31,285 (van Turnhout), each of which is incorporated by reference.

Layer 16 is a non-woven polymeric microfiber mat for filtering airborne contaminants. Mat 16 may be formed using conventional techniques for preparing non-woven microfiber mats such as the techniques described above in reference to mat 18. Preferred polymers for forming microfibers used in the construction of mat 16 include polyolefins (e.g. polyethylene, polypropylene, polybutylene, and poly-4-methylpentene), polyesters, polyamides (e.g., nylon), polycarbonates, polyphenylene oxide, polyurethanes, acrylic polymers, polyvinylchloride and mixtures thereof, with polypropylene being preferred. The liquid resistance and the filtration efficiency of layer 16 can be increased by incorporating a surface energy reducing agent such as a fluorochemical into the microfibers of layer 16 or onto the surface of the microfibers, as described above in reference to layer 18. Filtration is further improved by providing mat 16 in the form of an electret.

The invention will now be described further by way of the following examples.

EXAMPLES

Liquid Resistant Microfiber Mat Preparation

The microfiber mats were prepared as described generally in Wente, Van A., "Superfine Thermoplastic Fibers" in *Industrial Chemistry,* vol. 48, p. 1342 et seq. (1956), or in Report No. 4364 of the Naval Research Laboratories, published May 25, 1954, entitled, "Manufacture of Superfine Organic Fibers," by Wente, Van A., et al. The apparatus used to make the blown microfiber mats was a drilled die having circular smooth surface orifices (10/cm) having a 0.43 mm (0.017 inch) diameter and a 8:1 length to diameter ratio. An air pressure of 0.34 to 2.10 Bar (5–30 psi) with an air gap of 0.076 cm width was maintained for the drilled die. The polymer throughput rate was approximately 179 g/hr/cm for all runs.

Polymer pellets were prepared containing the fluorochemical and the polymer resin for forming the fibers, after which the pellets were extruded to form microfibers as described in the aforementioned Crater patents. The reaction conditions and mat components are set forth in Table 1. All percentages are given in weight percent.

TABLE I

| Run # | Resin | FCO (%) | Pigment (%) | Extrusion Temp. (°C.) | Primary Air Temp (°C.) |
|---|---|---|---|---|---|
| 1 | 78.5 PP<br>20.0 PB | 0.5 | 1.0 | 245–300 | 350 |
| 2 | 98.0 PP | 1.0 | 1.0 | 240–295 | 400 |

PP 3505 polypropylene resin (available from Exxon Chemical Co., Houston, TX)
PB 0400 polybutylene resin (available from Shell Oil Co., Houston, TX)
Pigment P-526 REMAFIN Blue BN-AP (available from Hoechst Celanese Corp., Charlotte, NC)

TABLE I-continued

| Run # | Resin | FCO (%) | Pigment (%) | Extrusion Temp. (°C.) | Primary Air Temp (°C.) |
|---|---|---|---|---|---|

FCO Fluorochemical oxazolidinone prepared according to the procedure described generally in Example 1 of Crater et al., U.S. Pat. No. 5,025,052 by reacting a monoisocyanate having the formula $O{=}C{=}N{-}C_{18}H_{17}$ with $C_{18}F_{17}SO_2N(CH_3)CH_2CH(OH)CH_2Cl$ to form an intermediate urethane, followed by treatment with $NaOCH_3$ to form the oxazolidinone.

The two mats were characterized by measuring the pressure drop across the web in millimeters water ("mm $H_2O$") as outlined in ASTM F 778-88 test method. The average effective fiber diameter ("EFD") of each mat in microns was calculated using an air flow rate of 32 liters/minute according to the method set forth in Davies, C. N., "The Separation of Airborne Dust and Particles," Institution of Mechanical Engineers, London, Proceedings 1B, 1952. The solidity and basis weight of each mat were also determined. The results are summarized in Table II.

TABLE II

| Run # | Basis Weight ($g/m^2$) | Solidity (%) | Effective Fiber Diameter (μm) | Pressure Drop (mm $H_2O$) |
|---|---|---|---|---|
| 1 | 19.3 | 7.0 | 9.8 | 0.38 |
| 2 | 16.5 | 5.7 | 10.5 | 0.25 |

Mask Preparations

A series of masks, each having four layers, were constructed according to the procedure generally described in U.S. Pat. No. 3,613,678 (Mayhew), incorporated herein by reference, with the exception that a four layer mask was constructed rather than a three layer mask. The layers used to construct the masks were selected from the following materials: a rayon cover layer (A), a rayon face-contacting layer (B), a polypropylene blown microfiber filtration layer (C), the mat from Run #1 above (D), the mat from Run #2 above (E), and a polyethylene film layer (F) commercially available from Tregedar Film Products of Cincinnati, Ohio under the trade designation "Vispore," and described in U.S. Pat. No. 3,929,135. Layers (A), (B), and (C) were prepared according to the procedure generally described in U.S. Pat. No. 3,613,678 (Mayhew). These layers were combined in different combinations to form a series of four layer masks.

Synthetic Blood Challenge Test

The masks were subjected to the synthetic blood challenge test. A solution of synthetic blood having 1000 ml deionized water, 25.0 g Acrysol G110 (available from Rohm and Haas, Philadelphia, Pa.), and 10.0 g Red 081 dye (available form Aldrich Chemical Co., Milwaukee, Wis.) was prepared. The surface tension of the synthetic blood was measured and adjusted so that it ranged between 40 and 44 dynes/cm by adding Brij 30, a nonionic surfactant available from ICI Surfactants, Wilmington, Del. as needed. The synthetic blood was then placed in a reservoir connected to a cannula located 45.7 cm from the front surface of the mask being challenged. The reservoir was pressurized with compressed air to the desired test challenge pressure. A solenoid control value was set to open for a specific and predetermined amount of time to allow 2.0 ml of synthetic blood to pass through a 0.084 cm diameter cannula. The synthetic blood exited the cannula under the set pressure condition, traveled 45.7 cm to the mask target and impacted the mask being challenged. This assault was repeated five times, or until visual penetration of the synthetic blood occurred. The results are summarized in Table III.

TABLE III

| Construction | Total Basis Weight ($g/m^2$) | Synthetic Blood Challenge Pressure (mm Hg) | Synthetic Blood Challenge Assaults (#) | Visual Penetration of Synthetic Blood (Y/N) |
|---|---|---|---|---|
| ABFC | 96.8 | 259 | 5 | N |
| ABFC | 96.8 | 310 | 1 | Y |
| ADBC | 83.6 | 310 | 5 | N |
| ABDC | 83.6 | 414 | 5 | N |
| AEBC | 80.8 | 259 | 5 | N |
| ABEC | 80.8 | 413 | 5 | N |

Other embodiments are within the following claims. For example, mat 18 may be disposed between face-contacting layer 12 and layer 16, rather than between cover layer 14 and layer 16. The ties for securing the mask to the head may include ear loops designed to fit over the ears of the wearer as described, e.g., in U.S. Pat. Nos. 4,802,473 and 4,941,470 (both Hubbard et al.).

The face mask may also include an air impervious material i.e., a material that substantially completely resists the flow of air or other gas therethrough or that has a substantially greater resistance to the flow of air than the mask. The air impervious material functions to overcome any tendency of the moist breath to rise upwardly and out of the area of the mask nearest the wearer's eyes. Face masks that incorporate air impervious materials are described, for example, in U.S. Pat. Nos. 3,890,966 (Aspelin et al.), 3,888,246 (Lauer), 3,974,826 (Tate, Jr.) and 4,037,593 (Tate, Jr.), incorporated herein by reference. The air impervious material is preferably a soft, pliable film of plastic or rubber material, and may be formed from materials such as, e.g., polyethylene, polypropylene, polyethylene-vinyl acetate, polyvinyl chloride, neoprene, polyurethane, and the like. Other suitable air impervious materials include, e.g., nonwoven fabric or paper type material having a substantially greater resistance to air flow than the filtration medium and facing material.

The air impervious material may include slits defining flaps that are outwardly movable away from the eyes of the wearer when subjected to the influence of exhaled breath, as described for example in U.S. Pat. No. 3,890,966 (Aspelin et al.). The slits provide paths through which exhaled breath may flow and direct the exhaled breath away from the eyeglasses of the wearer, thus substantially overcoming any tendency of the moist breath to rise upwardly and cause eyeglass fogging.

Alternatively, the air impervious material may be in the form of a non-porous closed cell foam material as described, e.g., in U.S. Pat. No. 4,037,593 (Tate, Jr.), or a porous soft foam material enclosed within a sleeve of air impervious material, as described, e.g., in U.S. Pat. No. 3,974,829 (Tate, Jr.).

The air impervious material is preferably located in the area of the mask that is nearest the eyes when the mask is worn. The air impervious material is preferably located so as not to compromise the breathability of the mask. For example, the air impervious material may be located near the upper edge of the mask on either one or more of the inner surface of the face-contacting layer, the outer surface of the cover layer, or folded over the upper edge of the mask such that it extends downward a short distance along both the surface of the face-contacting layer and the cover layer as described, e.g., in U.S. Pat. No. 3,888,246 (Lauer).

The air impervious material may be secured to the mask by any suitable method including, e.g., stitching, heat sealing, ultrasonic welding, and water-based or solvent-based adhesives (e.g., plasticized polyvinylacetate resin dispersion) in the form of a thin line, a band, a discontinuous coating, or a continuous coating.

The mask may further include a shield for protecting the wearer's face and inhibiting liquids from splashing into the eyes of the wearer. The shield is preferably highly transparent, flexible, possesses poor reflection properties, and is stiff enough to prevent collapse yet flexible enough to bend. Suitable materials for forming the shield include, e.g., polyester and polyethylene plastic. The shield may be secured to the mask at bond areas formed by adhesives, ultrasonic seals, heat seals, or by stitching. The shield is generally dimensioned to provide generous coverage to the eyes and parts of the head and to fit across the width of the mask. The shield may be removably attachable to the mask. The shield may be coated with a suitable anti-fogging chemical or an anti-glare silicone agent such as, e.g., dimethylsiloxane polymer. Examples of face masks constructed with shields are described in U.S. Pat. Nos. 5,020,533 (Hubbard et al.) and 4,944,294 (Borek, Jr.), and PCT Application No. WO 89/10106 (Russell).

Preferably, the shield is both anti-reflective and anti-fogging. Suitable anti-reflective, anti-fogging coatings which may be applied to the shield include inorganic metal oxides combined with hydrophilic anionic silanes as described, e.g., in U.S. Pat. No. 5,585,186 (Scholz et al.), and inorganic metal oxides in combination with certain anionic surfactants as described, e.g., in Published PCT Application No. 96/18691.

The mask may assume an off-the-face or "duckbill" configuration, as described, e.g., in U.S. Pat. No. 4,419,993.

In another embodiment, the sealed fit between the periphery of the mask and the contours of the wearer's face is enhanced by fluid impervious flaps that extend from the sides of mask toward the ears of the wearer as described, e.g., in U.S. Pat. No. 5,553,608 (Reese et al). The flaps also extend the coverage area of the face mask. The ties that secure the mask to the head combine with the flaps to conform the mask to the contours of the face of a wearer. The flaps are preferably formed from a liquid impervious material with a generally U-shaped cross-section, a J configuration or a C-fold configuration. The flaps may be formed from polyethylene film laminated to a non-woven material or from a wide variety of resilient and stretchable materials. One example of such a resilient material is rubber (e.g., extruded or injection molded as strips or sheets of material) available under the tradename KRATON™ from Shell Oil Company. Preferably, however, the flaps have the same construction as the main mask.

What is claimed is:

1. A face mask comprising:

a face-contacting layer;

an outer cover layer;

a polymeric microfiber mat disposed between said face-contacting layer and said outer cover layer; and a non-woven fibrous mat disposed between said face-contacting layer and said outer cover layer, said non-woven fibrous mat comprising polymeric fibers and a surface energy reducing agent, said face-contacting layer, said cover layer, said polymeric microfiber mat, and said non-woven fibrous mat cooperating with each other to allow gas to pass through said mask while inhibiting the passage of liquid through said mask.

2. The face mask of claim 1, wherein said non-woven fibrous mat is disposed between said polymeric microfiber mat and said cover layer.

3. The face mask of claim 1, wherein said non-woven fibrous mat is disposed between said face-contacting layer and said polymeric microfiber mat.

4. The face mask of claim 1, wherein said surface energy reducing agent comprises a fluorochemical, a wax, a silicone, or a combination thereof.

5. The face mask of claim 1, wherein said surface energy reducing agent comprises a fluorochemical.

6. The face mask of claim 1, wherein said surface energy reducing agent comprises a fluorochemical oxazolidinone, a fluorochemical piperazine, a fluoroaliphatic radical-containing compound, or a combination thereof.

7. The face mask of claim 1, wherein said surface energy reducing agent comprises a fluorochemical oxazolidinone.

8. The face mask of claim 1, wherein the amount of said surface energy reducing agent is no greater than about 4.0% by weight based upon the total weight of said mat.

9. The face mask of claim 1, wherein the amount of said surface energy reducing agent is no greater than about 2.0% by weight based upon the total weight of said mat.

10. The face mask of claim 1, wherein said non-woven fibrous mat comprises a surface energy reducing agent incorporated into said fibers.

11. The face mask of claim 1, wherein said non-woven fibrous mat comprises a surface energy reducing agent on the surface of said fibers.

12. The face mask of claim 1, wherein said non-woven fibrous mat comprises polymeric microfibers, staple fibers, continuous filament fibers, or a combination thereof.

13. The face mask of claim 1, wherein said non-woven fibrous mat comprises polymeric microfibers.

14. The face mask of claim 1, wherein said non-woven fibrous mat has an effective fiber diameter no greater than about 20 micrometers.

15. The face mask of claim 1, wherein said non-woven fibrous mat has an effective fiber diameter between about 1 and 10 micrometers.

16. The face mask of claim 1, wherein said non-woven fibrous mat has a solidity no greater than about 10%.

17. The face mask of claim 1, wherein the pressure drop across said non-woven fibrous mat ranges from between about 0.1 to about 2.70 mm $H_2O$ at a flow rate of 32 lpm and a face velocity of 3.82 cm/s.

18. The face mask of claim 1, wherein the pressure drop across said non-woven fibrous mat ranges from between about 0.1 to about 2.50 mm $H_2O$ at a flow rate of 32 lpm and a face velocity of 3.82 cm/s.

19. The face mask of claim 1, wherein the pressure drop across said non-woven fibrous mat ranges from between about 0.1 to about 1.50 mm $H_2O$ at a flow rate of 32 lpm and a face velocity of 3.82 cm/s.

20. The face mask of claim 1, wherein said non-woven fibrous mat has a basis weight ranging between about 10 and about 50 $g/m^2$.

21. The face mask of claim 1, wherein the area of said non-woven fibrous mat, measured by multiplying the length of said mat by the width of said mat prior to pleating, is at least about 2% greater than the corresponding area of any one of said face-contacting layer, said polymeric microfiber mat and said outer cover layer.

22. The face mask of claim 1, wherein said non-woven fibrous mat comprises an electret.

23. The face mask of claim 1, wherein said polymeric microfiber mat comprises a fluorochemical incorporated into said microfibers.

24. The face mask of claim 1, wherein said non-woven fibrous mat comprises polyolefin, polyamide, polyester, or polyvinylchloride microfibers, or a combination thereof.

25. The face mask of claim 1, wherein said non-woven fibrous mat comprises polyethylene, polypropylene, polybutylene, or poly-4-methylpentene microfibers, or a combination thereof.

26. The face mask of claim 1, wherein said non-woven fibrous mat comprises a blend of polypropylene and polybutylene microfibers.

27. The face mask of claim 1, wherein said non-woven fibrous mat comprises a blend of up to about 50% by weight polypropylene microfibers and up to about 50% by weight polybutylene microfibers.

28. The face mask of claim 1, wherein said non-woven fibrous mat comprises a blend of up to about 50% by weight polypropylene microfibers, up to about 50% by weight polybutylene microfibers, and about 0.5% by weight of a surface energy reducing agent comprising a fluorochemical.

29. The face mask of claim 1, wherein the basis weight of said mask is no greater than about 95 $g/m^2$.

30. The face mask of claim 1, wherein the pressure drop across said mask is no greater than about 2.70 mm $H_2O$ at a flow rate of 32 lpm and a face velocity of 3.82 cm/s.

31. The face mask of claim 1, further comprising an air impervious element secured to said mask to inhibit the flow of air to the eyes of the wearer of said mask.

32. The face mask of claim 1, further comprising a shield affixed to said mask to extend over and protect the eyes of the wearer of said mask.

33. The face mask of claim 1, further comprising a pair of flaps affixed to opposite sides of said mask to protect the face of the wearer from liquid.

34. The face mask of claim 1, wherein said mask assumes an off-the-face configuration.

35. A face mask comprising:

a face-contacting layer;

an outer cover layer;

a first mat comprising polymeric microfibers disposed between said face-contacting layer and said outer cover layer; and a second mat comprising polymeric microfibers disposed between said face-contacting layer and said outer cover layer, said second mat further comprising a fluorochemical incorporated into said microfibers, said face-contacting layer, said cover layer, and said first and second mats cooperating with each other to allow gas to pass through said mask while inhibiting the passage of liquid through said mask.

* * * * *